US012365521B2

(12) United States Patent
Tan et al.

(10) Patent No.: US 12,365,521 B2
(45) Date of Patent: Jul. 22, 2025

(54) NON-SPILL DRINKING LID AND ASSEMBLY

(71) Applicant: FITSON SINGAPORE PTE LTD, Singapore (SG)

(72) Inventors: Kuam Keng Tan, Johor (MY); Yi Wen Chan, Singapore (SG)

(73) Assignee: FITSON SINGAPORE PTE LTD, Singapore (SG)

( * ) Notice: Subject to any disclaimer, the term of this patent is extended or adjusted under 35 U.S.C. 154(b) by 0 days.

(21) Appl. No.: 18/700,616

(22) PCT Filed: Sep. 8, 2022

(86) PCT No.: PCT/SG2022/050644

§ 371 (c)(1),
(2) Date: Apr. 11, 2024

(87) PCT Pub. No.: WO2023/069009

PCT Pub. Date: Apr. 27, 2023

(65) Prior Publication Data

US 2024/0417146 A1 Dec. 19, 2024

(30) Foreign Application Priority Data

Oct. 18, 2021 (SG) ..... 10202111520Q

(51) Int. Cl.
*B65D 47/40* (2006.01)
*B65D 43/02* (2006.01)

(52) U.S. Cl.
CPC ..... *B65D 47/40* (2013.01); *B65D 43/0202* (2013.01); *B65D 2543/00046* (2013.01); *B65D 2543/00101* (2013.01)

(58) Field of Classification Search
CPC ..... A47G 19/2272; A47G 19/2266; A47G 19/2205; B65D 47/40
USPC ..... 215/11.5, 309, 311; 220/714, 203.16, 220/231
See application file for complete search history.

(56) References Cited

U.S. PATENT DOCUMENTS

| | | | | |
|---|---|---|---|---|
| 11,937,716 | B2 * | 3/2024 | Vang | B65D 43/0231 |
| 2013/0233870 | A1 * | 9/2013 | Miller | A47G 19/22 220/719 |
| 2018/0008069 | A1 * | 1/2018 | Beltrami | A47G 19/2272 |
| 2019/0021532 | A1 * | 1/2019 | Dunn | A47G 19/2272 |

(Continued)

OTHER PUBLICATIONS

International Search Report and Written Opinion issued in International Application PCT/SG2022/050644 dated May 3, 2023, 8 pages.

*Primary Examiner* — Javier A Pagan
(74) *Attorney, Agent, or Firm* — Rothwell, Figg, Ernst & Manbeck, P.C.

(57) ABSTRACT

A non-spill drinking lid comprising a first member, a second member, detachably attached to the first member and a collar detachably attached to the second member. The first member has a plurality of protrusions extending from an interior surface towards the second member, the plurality of protrusions are arranged to maintain a fluid channel between the first member and the second member, the first member comprises a flexible outer rim, the collar comprises an outer rim, and the flexible first member outer rim abuts the collar outer rim and the flexible first member outer rim is deformable to extend the fluid channel through the non-spill drinking lid.

16 Claims, 10 Drawing Sheets

(56) References Cited

U.S. PATENT DOCUMENTS

| | | | | |
|---|---|---|---|---|
| 2019/0159615 | A1* | 5/2019 | Maguire | B65D 47/2062 |
| 2020/0229625 | A1* | 7/2020 | Holschumacher | A47G 19/2272 |

* cited by examiner

NON-SPILL DRINKING LID AND ASSEMBLY

CROSS REFERENCE TO RELATED APPLICATION(S)

This application is a 35 U.S.C. ? 371 National Stage of International Patent Application No. PCT/SG2022/050644, filed Sep. 8, 2022, claiming benefit from Singapore Patent Application No. 10202111520Q, filed Oct. 18, 2021, the disclosures of which are incorporated herein in their entireties by reference, and priority is claimed to the foregoing.

FIELD OF THE INVENTION

The present disclosure relates to a drinking container lid and a drinking container assembly comprising the drinking container lid. More particularly, the container lid is spill-proof but a user can drink a liquid contained within the drinking container assembly.

BACKGROUND

Spilling of liquid from a drinking contain is a problem for a large cross-section of society from the very young to the elderly, who each may have cognitive or mobility limitations that hinder coordination or motor control, for example. Spill-proof drinking containers are known that prevent some or all of a content liquid from leaving a container, except for when a user is drinking from the container.

The examples described herein are not limited to examples which solve problems mentioned in this background section.

SUMMARY

Examples of preferred aspects and embodiments of the invention are as set out in the accompanying independent and dependent claims.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

A first overall aim is to minimise an amount of liquid that can be spilt from existing spill-proof containers.

A second overall aim is to minimise an impediment to drinking from a spill-proof container when drinking is performed by a user: for example, an impediment may relate to a reduced flow of liquid when drinking, a non-linear flow of liquid when drinking, a mouth of the container that is difficult to drink from for ergonomic reasons, or a shape of liquid stream that is not natural to a user, for example the liquid flows from too high at the sides of the container when a user is drinking.

A third overall aim is to provide a drinking container lid or a drinking container assembly that may be assembled and disassembled simply.

A fourth overall aim is to provide a drinking container lid with constituent parts that are easy to clean due to their shape and/or constructions materials.

A fifth overall aim is to minimise the angle that a non-spill container must be held in order to drink from it.

The below described aspects of the disclosed technology provide some or all of the above benefits over drinking container lids and drinking container assemblies of the prior art.

A first aspect is a non-spill drinking lid comprising a first member; a second member, detachably attached to the first member; and a collar detachably attached to the second member. The first member has a plurality of protrusions extending from an interior surface towards the second member; the plurality of protrusions are arranged to maintain a fluid channel between the first member and the second member; the first member comprises a flexible outer rim, the collar comprises an outer rim, the first member flexible outer rim abuts the collar outer rim, and the flexible first member outer rim is deformable to extend the fluid channel through the non-spill drinking lid.

Optionally, the second member further comprises a plurality of holes, and each hole of the plurality of holes extends the fluid channel through the second member.

Optionally, the second member further comprises an outer rim and the first member protrusions abut the second member proximal to the second member outer rim.

Optionally, the fluid channel is a first fluid channel: the second member further comprises an outer rim; the collar further comprises an inner wall; and the second member outer rim is spaced from the collar inner wall to provide a second fluid channel.

Optionally, the path of the second fluid channel is around the second member.

Optionally, the first fluid channel and the second fluid channel are open simultaneously.

Optionally, the first fluid channel and the second fluid channel diverge at a first side of the second member distal to the second member outer rim, and converge at a second side of the second member proximal to the second member outer rim.

Optionally, the plurality of protrusions are arranged concentrically with respect to the outer rim of the first member.

Optionally, the collar at least partially encloses the first member and the second member.

Optionally, the collar is detachably attached to the second member by a rotation of the second member relative to the collar.

Optionally, the first member further comprises a central protrusion, the second member further comprises a central hole and the second member is detachably attached to the first member by inserting the central protrusion of the first member into the central hole of the second member.

Optionally, the first member is formed from a flexible material, the second member is formed from a rigid material, and/or the collar is formed from a rigid material. Alternatively, the first member may be partially formed from a flexible material, such as such as a flexible material overmoulded on a rigid body.

Optionally, the drinking cup lid is attached to an opening of the container.

A second aspect is a method of assembling a non-spill drinking container lid comprising a first member, wherein the first member comprises a flexible outer rim, and a plurality of protrusions extending from an interior surface of the first member; a second member; and a collar, wherein the collar comprises an outer rim. The method comprising attaching the second member to the collar, and attaching the first member to the second member. When attached, the plurality of protrusions of the first member extend towards the second member, the plurality of protrusions are arranged to maintain a fluid channel between the first member and the second member, the flexible first member outer rim abuts the collar outer rim, and the flexible first member outer rim is deformable to extend the fluid channel through the non-spill drinking lid.

It will also be apparent to anyone of ordinary skill in the art, that some of the preferred features indicated above as preferable in the context of one of the aspects of the disclosed technology indicated may replace one or more preferred features of other ones of the preferred aspects of the disclosed technology. Such apparent combinations are not explicitly listed above under each such possible additional aspect for the sake of conciseness.

Other examples will become apparent from the following detailed description, which, when taken in conjunction with the drawings, illustrate by way of example the principles of the disclosed technology.

BRIEF DESCRIPTION OF THE DRAWINGS

The accompanying drawings illustrate various examples of the disclosure.

Figure 1:
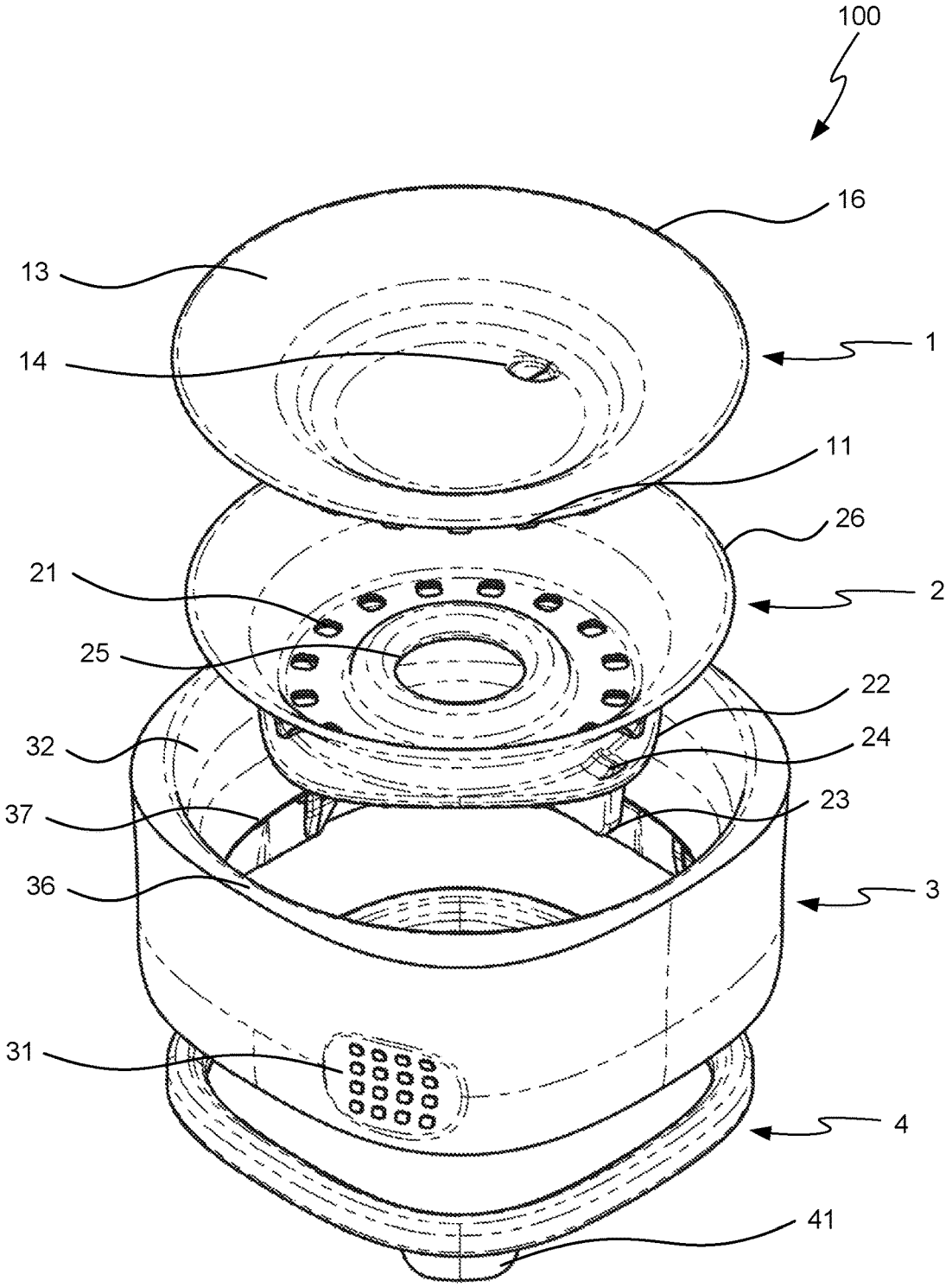
FIG. 1 illustrates an exploded perspective view of a drinking container lid.

The skilled person will appreciate that the illustrated element boundaries (e.g., boxes, groups of boxes, or other shapes) in the drawings represent one example of the boundaries. It may be that in some examples, one element may be designed as multiple elements or that multiple elements may be designed as one element. Common reference numerals are used throughout the figures, where appropriate, to indicate similar features.

DETAILED DESCRIPTION

The following description is made for the purpose of illustrating the general principles of the present technology and is not meant to limit the inventive concepts claimed herein. As will be apparent to anyone of ordinary skill in the art, one or more or all of the particular features described herein in the context of one embodiment are also present in some other embodiment(s) and/or can be used in combination with other described features in various possible combinations and permutations in some other embodiment(s).

Figure 5:
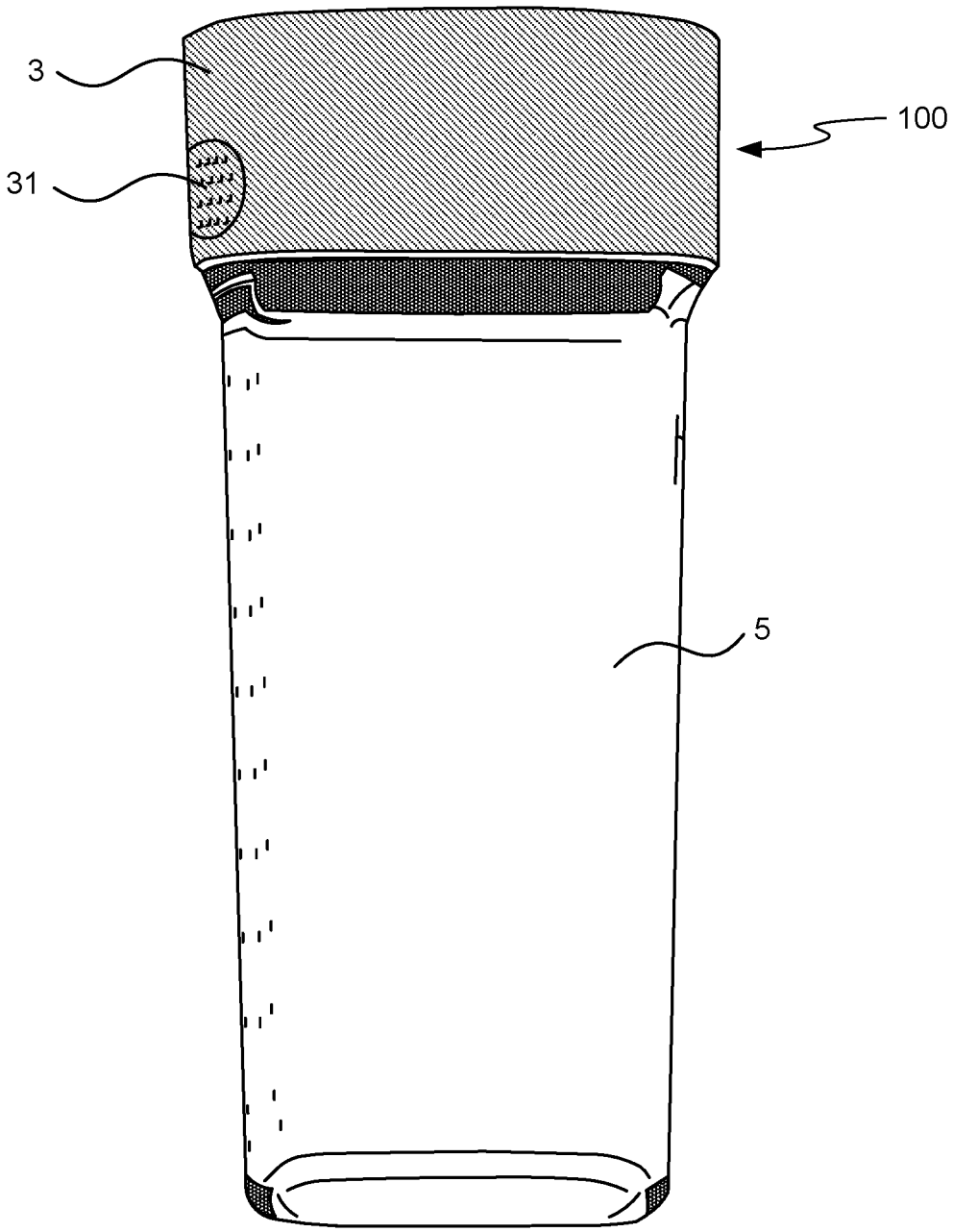
FIG. 5 illustrates a perspective side-view of a drinking container assembly.

FIG. 1 of the accompanying drawings shows illustrates an exploded perspective view of a drinking container lid 100. The drinking container lid 100 comprises a first member 1, a second member 2, a collar 3 and seal 4. The seal 4 provides an improved liquid-tight fit between the lid 100 and a container 5, such as is illustrated in FIG. 5.

The first member 1 of the drinking container lid 100 has a circular outer rim 16. An upper surface 13 of the first member 1 slopes down towards the centre of the first member 1. The slope of the upper surface of the first member 1 is, generally, most shallow at an inner section where it is largely flat, steepest in a middle section surrounding the inner section and less steep in an outer section that ends at the first member outer rim 16. In an alternative configuration, not illustrated in the drawings, the inner section of the upper surface of the first member 1 may be dome shaped rather than largely flat. On a lower surface of the first member 1 are a plurality of protrusions 11 that are partially visible in FIG. 1. The protrusions 11 are provided on the outer section of the first member 1 and project from the lower surface of the first member 1. In the illustrated example, the protrusions 11 are regularly space and concentric to the first member outer rim 16. In other non-illustrated examples, the protrusions may be irregularly spaced and the distance between the protrusions and the outer rim 16 may vary. The first member 1 is illustrated to include a valve 14 between its upper and lower surfaces. The valve 14 is formed to be openable when there is a pressure differential across the upper and lower surfaces of the upper disk 1, wherein the pressure differential is generated when drinking occurs. The primary function of the valve 14 is to allow equalisation of pressure within a drinking cup when drinking is occurring, Preferably, valve 14 is a two-way valve.

The second member 2 of the drinking container lid 100 fits between the first member 1 and the collar 3, and the second member outer rim 26 is surrounded by the collar 3. An upper surface of the second member 2 is concave and able to receive the lower surface of the first member 1, which is convex.

Figure 10:
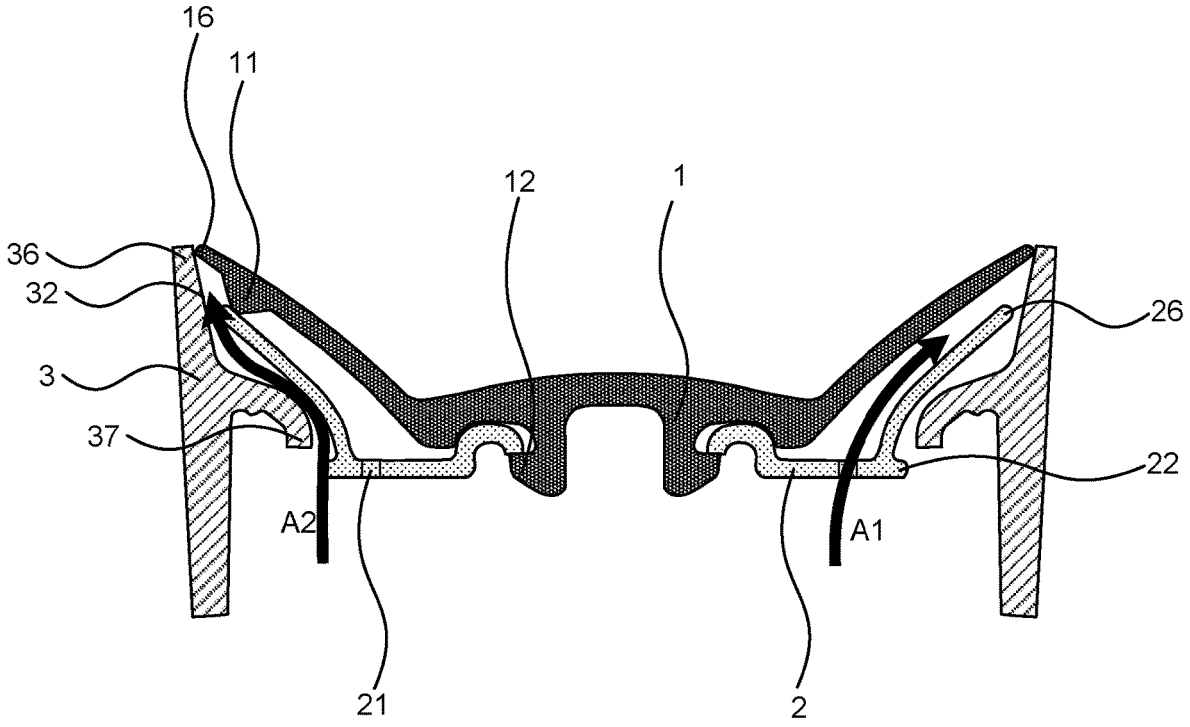
FIG. 10 illustrates a cross-section of a drinking container lid.

The upper surface of the second member 2 is able to receive the lower surface of the first member 1 as the upper surface of the second member 2 has a sloped outer section extending from the outer rim 26 towards the centre of the second member 2. The sloped outer section of the upper surface of the second member 2 meets a middle section that is largely flat. The middle section of the second member 2 has a plurality of holes 21 arranged concentrically with respect to the outer rim 26 of the second member 2. The holes 21 extend through the second member 2 from the upper surface to a lower surface of the second member 2. The holes 21 provide a passage through which fluid can flow. The holes 21 are illustrated to have a sqround shaped, i.e. rectangular with rounded corners, but may take other shapes and, optionally, other non-repeating shapes. Within the middle section of the second member 2 is a central section that is sloped upwards, towards the first member 1. The middle section of the second member 2 has a central opening 25. The central opening 25 of the second member is arranged to receive a central protrusion 12 of the first member 1; the central protrusion 12 of the first member 1 is not shown in FIG. 1 but is illustrated in FIG. 10.

Figure 8:
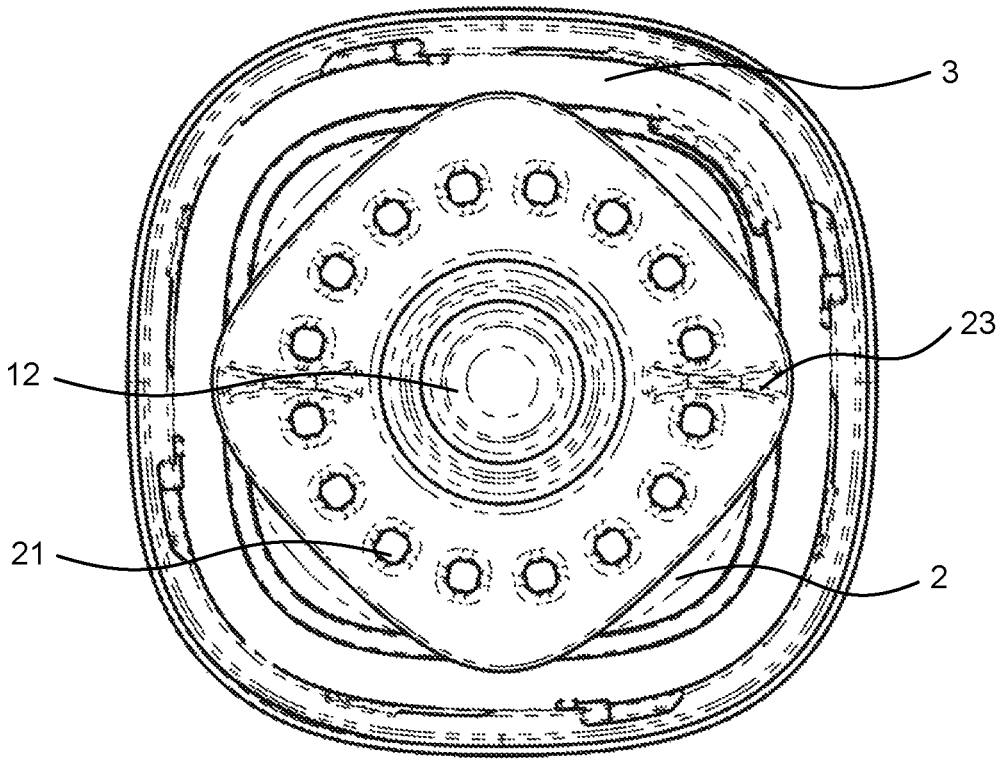
FIG. 8 illustrates a bottom perspective view of aspects of a drinking container lid.

The second member 2 has a locking collar 22 forming part of its lower surface. The locking collar 22 of the second member 2 enables mechanical engagement of the second member 2 with the collar 3 by rotation of the second member 2 respective to the collar 3 when the second member 2 is inserted into the collar 3. FIG. 8 illustrates a perspective view of the underside of the second member 2 after it has been inserted into the collar 3 and rotated to lock it into place. The locking collar 22 is illustrated as being sqround shaped, but other shaped locking collars are foreseen. The collar 3 has a sqround-shaped opening at its centre that locking collar 22 can pass through when aligned, but not pass through when it is mis-aligned as illustrated in FIG. 8, in which the second member 2 and the collar 3 are mechanically engaged. In the illustrated example, the locking collar 22 and the collar opening are both sqround-shaped, however this is not essential for their detachable engagement and other shapes may be used for the interlocking process, and the interlocking shapes need not match. The shape of the collar opening must allow the locking collar shape to fit though dependent upon the degree of rotation of the locking collar. The lower surface of the second member 2 is illustrated having two handles 23 projecting from the locking collar 22 away from the first member 1. The handles 23 facilitate rotation of the second member 2 to aid locking and/or unlocking of the second member 2 and the collar 3. While two handles 23 are illustrated in various figures, other configurations with more or fewer handles, including no handles, are envisaged.

The collar 3 has a sqround exterior profile with a large central axial passage between an upper surface and a lower surface. The upper surface of the collar 3 has a collar rim 36 that forms a drinking surface for engaging with a mouth of a user. The exterior of the collar 3 may be of a different profile, such as round or square, for example, rather than sqround as illustrated. The collar 3 has a smooth interior wall 32 shaped to receive the second member 2. The interior wall includes a ridge 37 shaped so as not to engage with the second member 2 when the second member 2 is not in an engaged position with respect to the collar 3, but to engage with the second member 2 to lock it into position with respect to the collar 3 when the second member 2 is in an engaged position by the rotation of the second member 2 with respect to the collar 3. The second member 2 has a plurality of notches 24 extending from an upper surface of the locking collar 22. The notches 24 of the second member 2 contact and press against the ridge 37 of the collar 3 when the second member 2 and the collar 3 are in their engaged position.

The exterior wall of the collar 3 has a grip section 31 to facilitate the rotational engagement process. Optionally, the drinking container lid 100 includes a removable seal 4 that prevents liquid escaping from between the collar 3 and a container 5 when the lid 100 is attached to a container 5. The seal has a tab 41 that facilitates removal of the seal 4 from a recess with the collar 3 when the seal is to be cleaned or replaced. The seal 4 may be made from a rubber or rubber-like material. Alternatively, the seal 4 may be partially formed from a flexible material, for example a flexible material overmoulded on a rigid body.

The lid 100 components of the first member 1, second member 2, collar 3 and seal 4 are all removable, replaceable and serviceable. Regular cleaning and sterilisation of one or more of the components is made possible. While the various components of the lid 100 are illustrated and described as being detachable from each other, one or more of components may be permanently affixed instead.

Figure 2:
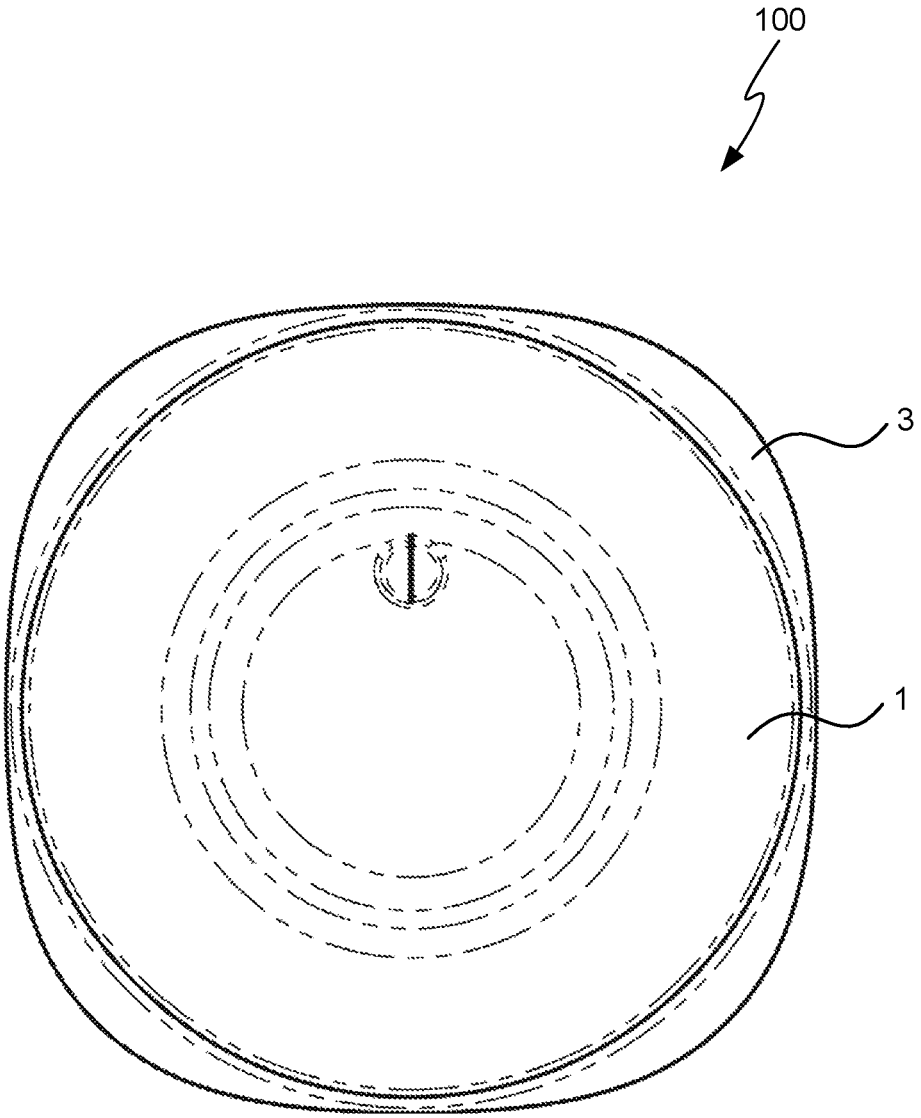
FIG. 2 illustrates a top view of the drinking container lid.

FIG. 2 of the accompanying drawings illustrates a top view of the drinking container lid 100 where the first member 1 is surrounded by the collar rim 32. The gap between the collar rim and the first member encircles the upper surface of the lid 100 so that drinking can occur at any point around the collar rim 32.

Figure 3:
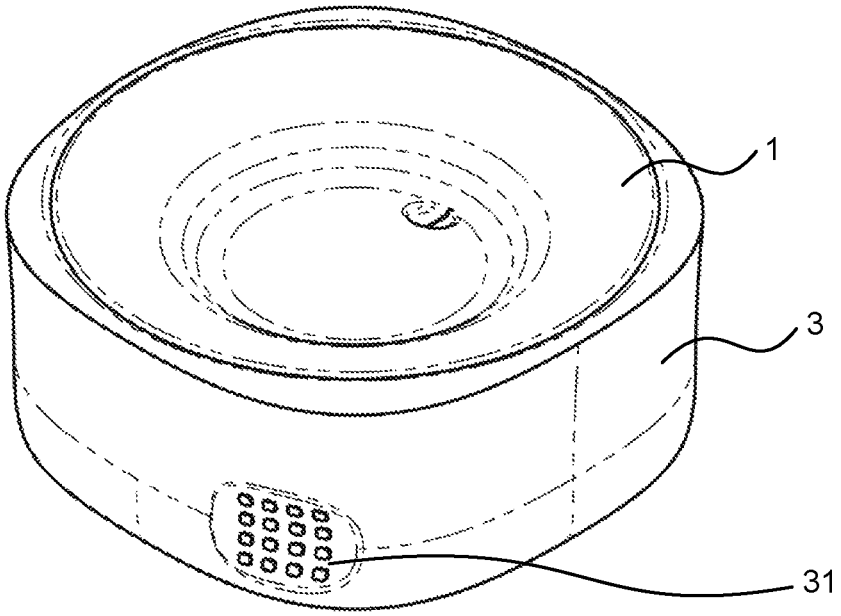
FIG. 3 and FIG. 4 illustrate perspective views of the drinking container lid.
Figure 4:
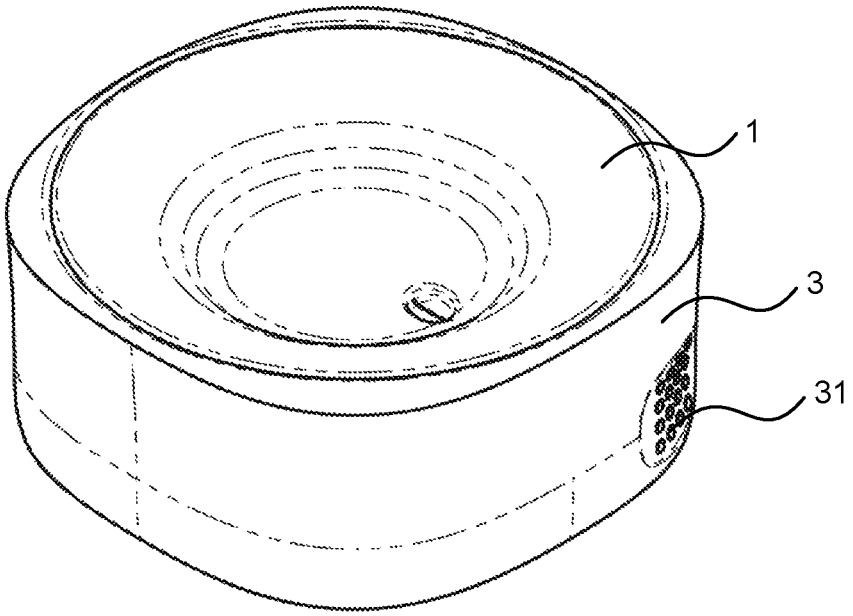

FIGS. 3 and 4 of the accompanying drawings illustrate perspective views of the drinking container lid 100. The collar 3 includes a grip 31 that, as well as facilitating the engagement process, also aids a user to hold the lid 100 during normal use when a drinking container 5 is attached.

FIG. 5 of the accompanying drawings illustrates a perspective side-view of a drinking container assembly comprising the drinking container lid 100 and a container 5. Various differently shaped containers may be connected to the lid 100.

Figure 6:
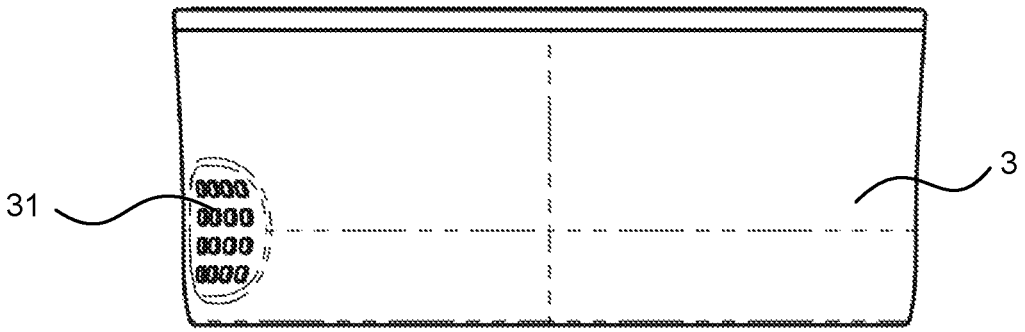
FIG. 6 and FIG. 7 illustrate a side profile view of the drinking container lid.
Figure 7:
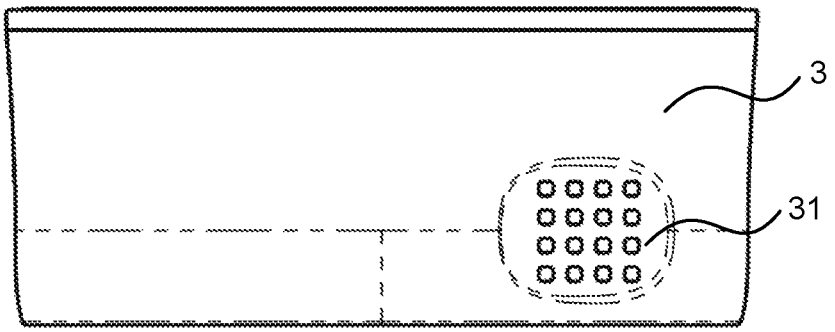

FIGS. 6 and 7 of the accompanying drawings illustrate a side profile view of the drinking container lid 100 where the collar 3 is predominantly visible. The collar 3 provides structure and rigidity to the drinking container lid, protecting the first member 1 and the second member 2.

Figure 9:
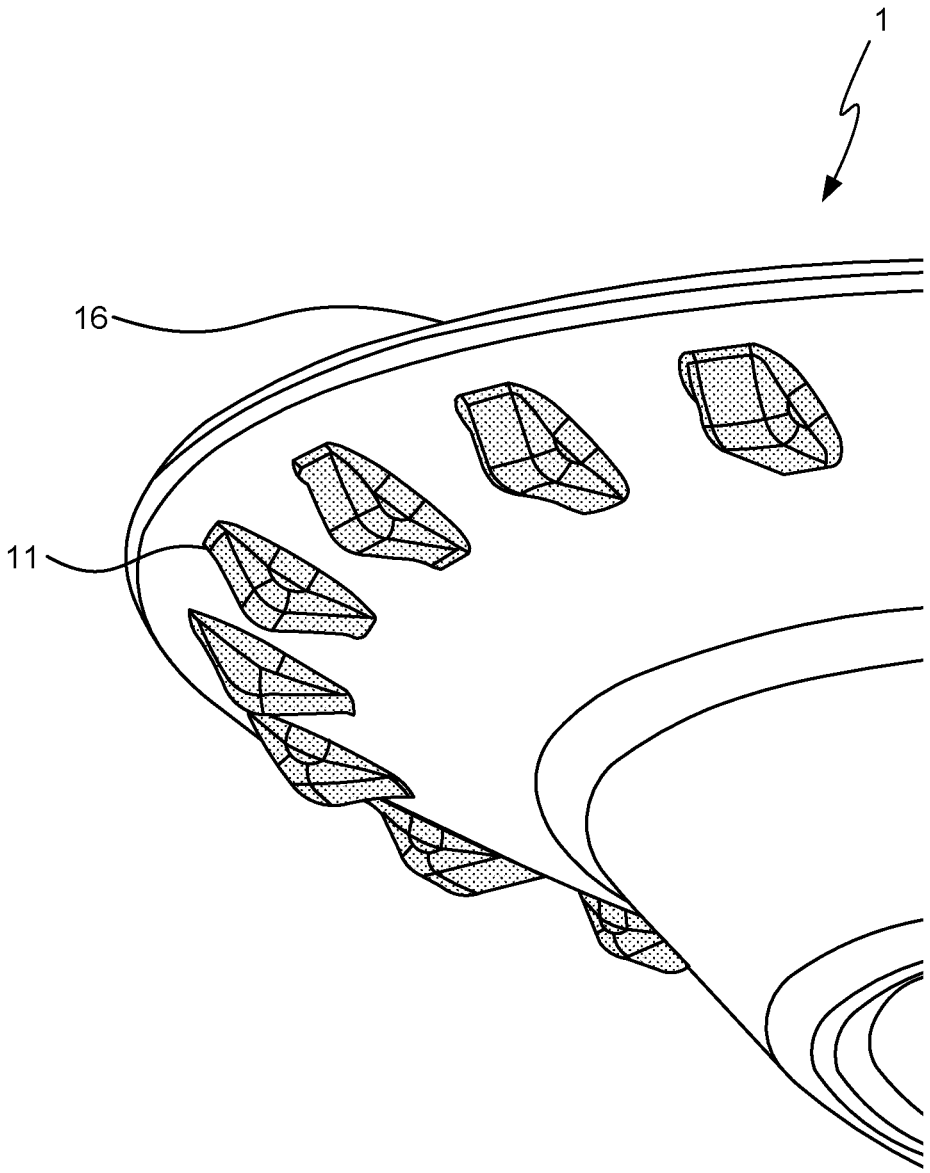
FIG. 9 illustrates a perspective view of a component of a drinking container lid.

FIG. 9 of the accompanying drawings illustrates a perspective view of example protrusions 11 on the lower surface of the first member 1. The protrusions 11 maintain a separation between the lower side of the first member 1 and the upper side of the second member 2. The protrusions 11 of the first member 1 are shaped to provide a rounded point that may contact the upper side of the second member 2 to allow the outer section of the first member 1 to flex and pivot about the point to open a channel between the first member rim 16 and the collar rim 26 to maximise liquid to flow therethrough.

FIG. 10 illustrates a cross-section of the drinking container lid 100, when it is assembled. The lid 100 is assembled as the central protrusion 12 of the first member 1 has been inserted into the central opening 25 of the second member 2, and the second member 2 has been inserted in and rotated relative to the collar 3 thereby locking it into place. More specifically, the first member 1 is mechanically fastened to the second member 2 by the mechanical engagement of the central protrusion 12 of first member with the central opening 25 of the second member 2. The push fit engagement of the relatively elastic first member 1 with the relatively inelastic second member 2 provides the engagement, however other examples may use other types of fit, such as an interference fit.

The first member 1 may be made from an elastic, rubberlike material to provide an improved engagement with a mouth of a user when drinking, and also to enable a good liquid-tight seal between the first member rim 16 and the collar rim 26 when drinking is not occurring in order to prevent spillages. The first member protrusions 11 maintain separation of the first member 1 from the second member 2 proximal to the second member rim 26. Fluid can flow through the container lid 100 via the two channels A1, A2 represented by arrows in FIG. 10. The first channel A1 involves fluid flowing through holes 21 in the second member 2, and then between the first member 1 and the second member 2—the first member protrusions 11 maintain a channel opening for the second channel. The second channel A2 involves fluid flowing between the second member locking collar 22 and the collar ridge 37, and then between the second member rim 26 and the collar interior wall 32. During drinking, the pressure presented by a user's mouth (an upper lip of the user presenting against an upper surface 13 of the first member 1) deforms the shape of the first member 1 proximal to the first member rim 16, and the deformation enables fluid to flow, via at least one of the two aforementioned channels A1, A2, between the first member rim 16 and the collar rim 36.

Non-spill drinking devices are often may by used by people with a developing or weakened immune system, either the very young or the elderly for example, so device hygiene is of the upmost importance. The components of the container lid 100 are both highly accessible for cleaning via a partial or full disassembly, and the component parts are easy to keep clean. Also, the examples described herein maximise the flow of fluid through the drinking container lid when drinking occurs.

Numerous advantages are provided by features illustrated in FIGS. 1 and 10. The protrusions 11 for maintaining fluid channel A1 are on the first member 1 rather than the second member so as to minimise the disruption of fluid flow via channel A1 across the upper face of the second member 2 while drinking occurs. The first member 1 and second member 2 are formed separately. The first member 1 alone may be formed of a soft, deformable and/or elastic material to maximise ease of both drinking and cleaning; the protrusions 11 are on the first member 1 that they are easy to remove and clean as it is the most accessible component part to a user. There are no such protrusions on the second member 2 or collar 3 that would reduce the hygiene of the device and/or require more regular cleaning. Further, such protrusions or projections on the second member 2 or collar 3, in either of the fluid channels A1, A2, may be avoided as they could affect the flow of fluid when drinking occurs.

The second fluid channel A2 is activated at a shallower drinking angle than the first fluid channel A1, which means that drinking may occur at a shallower device angle which is important for users with reduced mobility. The availability of the first fluid channel A1 increases a maximum total fluid flow through the container lid 100.

A reservoir of liquid held in the drinking container lid 100 is minimised to prevent spillages, the reservoir being the volume between the first and second members.

The collar 3 provides a smooth exterior and smooth collar lip 36 with no additional frame in order to enable the greatest variance of mouth shapes to properly engage with the lid 100 to facilitate drinking.

Figure 11C:
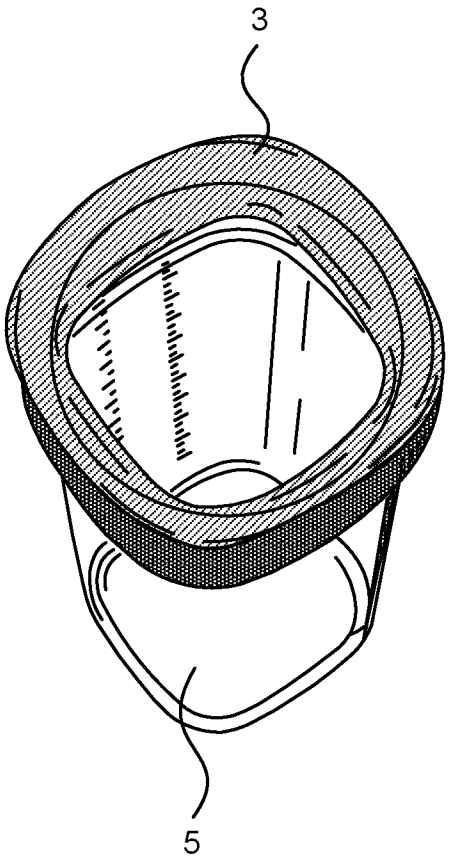
FIG. 11A-C illustrates the functionality of combinations of components of the drinking container lid and assembly.
Figure 11B:
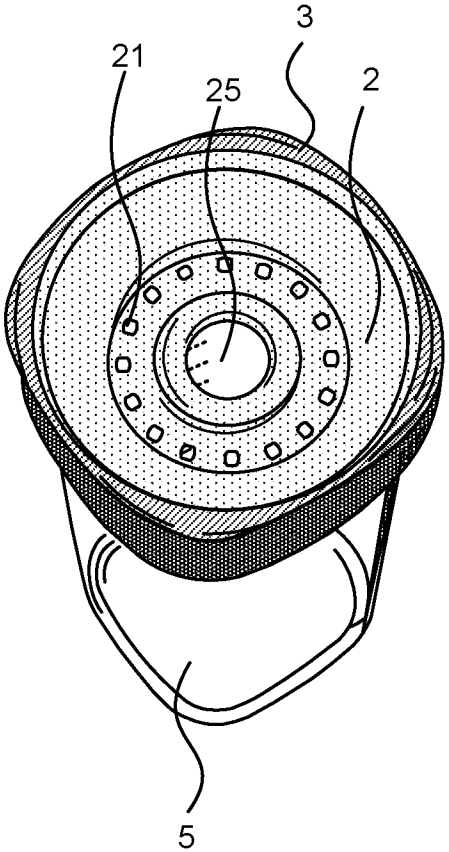
Figure 11A:
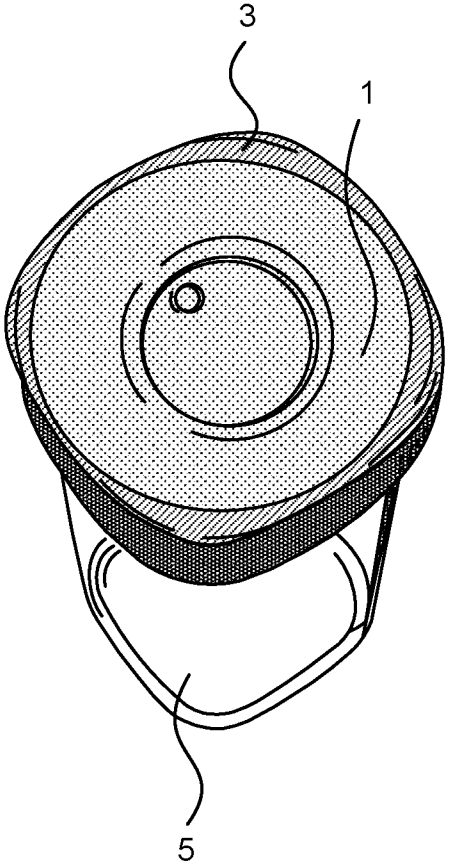

FIGS. 11A, 11B and 11C illustrate three modes of use of the component parts that form the container lid 100 when attached to a drinking container 5.

A first mode illustrated in FIG. 11A includes the first member 1, the second member 2, the collar 3, the seal 4 and the drinking container 5. The first mode provides a non-spill drinking container.

A second mode illustrated in FIG. 11B includes the second member 2, the collar 3, the seal 4 and the drinking container 5. The second mode provides the user access to the central opening 25 of the second member 2 through which liquids can be added to the container 5 or solids can be added to the container for infusion of liquids therein. The opening 25 also enables a straw to be inserted and used with the device, so drinking for the elderly is further facilitated in this mode. Further, the second member holes 21 provide an interface where food can be pressed against to crush the food before it enters the container 5. The use of the holes 21 as a crusher enables soft foods such as sweet potato, carrot, banana, etc. to be pureed into the container 5.

A third mode illustrated in FIG. 11C includes the collar 3, the seal 4 and the drinking container 5 and provides a wide opening for drinking via the collar 3.

The smooth and level nature of the first member, second member and collar edges 16, 26, 36 provide a suitable drinking surface to a user whichever combination of components of FIGS. 11A-C are selected for use.

The first member 1 may be fully or partially made of silicone material. The second member 2 may be fully or partially made from polyphenylsulfone. The crown 3 may be fully or partially made of polypropylene material. The seal 4 may be fully or partially made of silicone material. The container 5 may be fully or partially made of polyphenylsulfone material.

Figure 12:
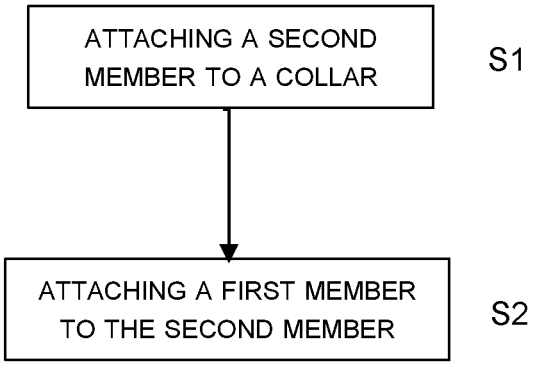
FIG. 12 illustrates a flow chart of a method associated with the assembly of a drinking container lid.

FIG. 12 of the accompanying drawings illustrates a flow chart of a method assembling a non-spill drinking container lid comprising a first member, a second member and a collar, wherein the first member comprises a flexible outer rim, the first member comprises a plurality of protrusions extending from an interior surface of the first member, and the collar comprises an outer rim.

The method comprises a first step S1 of attaching a second member to a collar member, and method comprises a second step S2 of attaching a first member to a second member. When attached, the plurality of protrusions of the first member extend towards the second member, the plurality of protrusions are arranged to maintain a fluid channel between the first member and the second member, the flexible first member outer rim abuts the collar outer rim, and the flexible first member outer rim is deformable to extend the fluid channel through the non-spill drinking lid.

A further non-illustrated example of the disclosure is a method disassembling the non-spill drinking container lid, wherein the steps of the method of assembly are reversed for disassembly.

A yet further non-illustrated example of the disclosure is a non-spill drinking container lid produce provided by the process of assembly described above.

Any reference to 'an' item refers to one or more of those items. The term 'comprising' is used herein to mean including the method blocks or elements identified, but that such blocks or elements do not comprise an exclusive list and an apparatus may contain additional blocks or elements and a method may contain additional operations or elements. Furthermore, the blocks, elements and operations are themselves not impliedly closed.

The steps of the methods described herein may be carried out in any suitable order, or simultaneously where appropriate. The arrows between boxes in the figures show one example sequence of method steps but are not intended to exclude other sequences or the performance of multiple steps in parallel. Additionally, individual blocks may be deleted from any of the methods without departing from the spirit and scope of the subject matter described herein. Aspects of any of the examples described above may be combined with aspects of any of the other examples described to form further examples without losing the effect sought.

Where the description has explicitly disclosed in isolation some individual features, any apparent combination of two or more such features is considered also to be disclosed, to the extent that such features or combinations are apparent and capable of being carried out based on the present specification as a whole in the light of the common general knowledge of a person skilled in the art, irrespective of whether such features or combinations of features solve any problems disclosed herein. In view of the foregoing description it will be evident to a person skilled in the art that various modifications may be made within the scope of the invention.

The invention claimed is:

1. A non-spill drinking lid comprising:

a first member;

a second member, detachably attached to the first member; and a collar detachably attached to the second member; wherein the first member has a plurality of protrusions extending from an interior surface towards the second member;

the plurality of protrusions are arranged to maintain a fluid channel between the first member and the second member;

the first member comprises a flexible outer rim, the collar comprises an outer rim, the first member flexible outer rim abuts the collar outer rim, and the flexible first member outer rim is deformable to extend the fluid channel through the non-spill drinking lid.

2. The non-spill drinking lid as claimed in claim 1, wherein the second member further comprises a plurality of holes, and each hole of the plurality of holes extends the fluid channel through the second member.

3. The non-spill drinking lid as claimed in claim 1, wherein the second member further comprises an outer rim and the first member protrusions abut the second member proximal to the second member outer rim.

4. The non-spill drinking lid as claimed in claim 1, wherein the fluid channel is a first fluid channel;

the second member further comprises an outer rim;

the collar further comprises an inner wall; and the second member outer rim is spaced from the collar inner wall to provide a second fluid channel.

5. The non-spill drinking lid as claimed in claim 4, wherein the path of the second fluid channel is around the second member.

6. The non-spill drinking lid as claimed in claim 4, wherein the first fluid channel and the second fluid channel are open simultaneously.

7. The non-spill drinking lid as claimed in claim 4, wherein the first fluid channel and the second fluid channel diverge at a first side of the second member distal to the second member outer rim, and converge at a second side of the second member proximal to the second member outer rim.

8. The non-spill drinking lid as claimed in claim 1, wherein the plurality of protrusions are arranged concentrically with respect to the outer rim of the first member.

9. The non-spill drinking lid as claimed in claim 1, wherein the collar at least partially encloses the first member and the second member.

10. The non-spill drinking lid as claimed in claim 1, wherein the collar is detachably attached to the second member by a rotation of the second member relative to the collar.

11. The non-spill drinking lid as claimed in claim 1, wherein the first member further comprises a central protrusion, the second member further comprises a central hole and the second member is detachably attached to the first member by inserting the central protrusion of the first member into the central hole of the second member.

12. The non-spill drinking lid as claimed in claim 1, wherein the first member is formed from a flexible material, or the first member is partially formed from a flexible material.

13. The non-spill drinking lid as claimed in claim 1, wherein the second member is formed from a rigid material.

14. The non-spill drinking lid as claimed in claim 1, wherein the collar is formed from a rigid material.

15. A drinking cup comprising a container and the non-spill drinking cup lid of claim 1, wherein the non-spill drinking lid is attached to an opening of the container.

16. A method of assembling a non-spill drinking container lid comprising a first member, wherein the first member comprises a flexible outer rim, and a plurality of protrusions extending from an interior surface of the first member; a second member; and a collar, wherein the collar comprises an outer rim;

the method comprising:

attaching the second member to the collar; and attaching the first member to the second member; wherein when attached:

the plurality of protrusions of the first member extend towards the second member, the plurality of protrusions are arranged to maintain a fluid channel between the first member and the second member, the flexible first member outer rim abuts the collar outer rim, and the flexible first member outer rim is deformable to extend the fluid channel through the non-spill drinking container lid.

* * * * *